US008128521B1

(12) United States Patent
Ulmer

(10) Patent No.: US 8,128,521 B1
(45) Date of Patent: Mar. 6, 2012

(54) MECHANICAL BROADHEAD WITH PIVOTING, INTERLOCKING BLADES

(76) Inventor: Russell Karl Ulmer, Overgaard, AZ (US)

( * ) Notice: Subject to any disclaimer, the term of this patent is extended or adjusted under 35 U.S.C. 154(b) by 0 days.

(21) Appl. No.: 12/896,340

(22) Filed: Oct. 1, 2010

Related U.S. Application Data

(60) Provisional application No. 61/372,734, filed on Aug. 11, 2010.

(51) Int. Cl.
*F42B 6/08* (2006.01)

(52) U.S. Cl. ..... 473/583

(58) Field of Classification Search ..... 473/583, 473/584
See application file for complete search history.

(56) References Cited

U.S. PATENT DOCUMENTS

| | | | | |
|---|---|---|---|---|
| 3,036,395 | A * | 5/1962 | Nelson | 43/6 |
| 3,138,383 | A * | 6/1964 | McKinzie | 473/583 |
| 3,618,948 | A * | 11/1971 | McGlocklin | 473/583 |
| 4,504,063 | A | 3/1985 | LeBus | |
| 4,537,404 | A | 8/1985 | Castellano et al. | |
| 4,973,060 | A | 11/1990 | Herzing | |
| 4,998,738 | A | 3/1991 | Puckett | |
| 5,078,407 | A | 1/1992 | Carlston et al. | |
| 5,082,292 | A | 1/1992 | Puckett et al. | |
| 5,083,798 | A | 1/1992 | Massey | |
| 5,100,143 | A | 3/1992 | Pucket | |
| 5,112,063 | A | 5/1992 | Puckett | |
| 5,178,398 | A | 1/1993 | Eddy | |
| 5,286,035 | A * | 2/1994 | Ward | 473/584 |
| 5,322,297 | A | 6/1994 | Smith | |
| 5,820,498 | A | 10/1998 | Maleski | |
| 5,879,252 | A * | 3/1999 | Johnson | 473/583 |
| 6,200,237 | B1 | 3/2001 | Barrie | |
| 6,217,467 | B1 | 4/2001 | Maleski | |
| 6,270,435 | B1 | 8/2001 | Sodaro | |
| 6,322,464 | B1 | 11/2001 | Sestak | |
| 6,517,454 | B2 | 2/2003 | Barrie et al. | |
| 6,595,881 | B1 | 7/2003 | Grace, Jr. et al. | |
| 6,626,776 | B2 | 9/2003 | Barrie et al. | |
| 6,669,586 | B2 | 12/2003 | Barrie et al. | |
| 6,830,523 | B1 * | 12/2004 | Kuhn | 473/583 |
| 6,910,979 | B2 | 6/2005 | Barrie et al. | |
| 7,226,375 | B1 | 6/2007 | Sanford | |
| 7,677,995 | B1 | 3/2010 | Sanford | |
| 7,713,151 | B2 | 5/2010 | Fulton | |
| 7,713,152 | B1 * | 5/2010 | Tentler et al. | 473/583 |
| 7,717,814 | B1 | 5/2010 | Sanford | |
| 8,016,704 | B1 * | 9/2011 | Vandewater | 473/583 |
| 2001/0036876 | A1 | 11/2001 | Barrie et al. | |
| 2003/0004021 | A1 | 1/2003 | Barrie et al. | |
| 2003/0153417 | A1 | 8/2003 | Barrie et al. | |
| 2004/0127299 | A1 | 7/2004 | Barrie et al. | |
| 2006/0084535 | A1 | 4/2006 | Kuhn | |
| 2007/0161438 | A1 | 7/2007 | Fulton | |
| 2009/0170644 | A1 | 7/2009 | Sames | |
| 2010/0004078 | A1 | 1/2010 | Flanagan | |
| 2010/0173734 | A1 | 7/2010 | Robbins | |

* cited by examiner

*Primary Examiner* — John Ricci
(74) *Attorney, Agent, or Firm* — John D. Titus

(57) ABSTRACT

A mechanical broadhead arrowhead has moveable blades that deploy from a retracted in-flight configuration to an outward deployed configuration as the broadhead strikes the target. Once in the deployed configuration, the blades are locked to each other against the resistance of the target, but freely pivot about the ferrule. Accordingly, if one blade strikes an obstruction such as a solid bone, the blade assembly simply pivots out of the way without damaging the blade, deflecting the trajectory of the arrow, or halting its penetration into the target.

13 Claims, 3 Drawing Sheets

MECHANICAL BROADHEAD WITH PIVOTING, INTERLOCKING BLADES

CROSS-REFERENCE TO RELATED APPLICATIONS

This application claims the benefit of Provisional Patent Application Ser. No. 61/372,734 filed Aug. 11, 2010.

BACKGROUND OF THE INVENTION

The present invention relates to the field of archery and in particular to broadhead arrowheads often referred to simply as broadheads.

Broadheads having blades that are held in a retracted configuration during flight that are moved to a deployed, expanded position when the arrow strikes the target are well known in the art. These mechanical broadheads overcome the wind drag and stability problems associated with fixed-blade broadheads. Mechanical broadheads can be classified generally into two categories. Broadheads in which the movable blades are pivoted rearward of the center of the blade so that the blades are swept forward during flight are often referred to as "forward-deployed" mechanical broadheads. U.S. Pat. No. 6,217,467 to Maleski and U.S. Pat. No. 6,595,881 to Grace, Jr. et al. are examples of forward-deployed mechanical broadheads. In each case, because the blades are pivoted behind the center of the blade, as the blade strikes the target, a torque couple is generated about the pivot access which causes the blades to pivot outwards and backwards approximately 120 degrees to form the broadhead arrow tip. Forward-deployed mechanical broadheads have an advantage in that the deployment mechanism is simple and straightforward, however, they suffer from the disadvantage that since the blades must move through such a large angle, the reaction forces exert significant stress on the blades and hinge, and substantial impact energy is consumed by the deployment process. Prior art forward-deployed mechanical broadheads also suffer from the fact that in the deployed configuration, the blades are typically locked to the ferrule. Accordingly, if one blade strikes an obstruction, such as a heavy bone, the impact may deflect the arrow's trajectory, significantly reduce the depth of penetration into the target, and/or damage the blade.

Mechanical broadheads in which the blades are pivoted forward of the center of the blade so that the blades are swept backwards during flight are often referred to as "rearward-deployed" mechanical broadheads. U.S. Pat. No. 6,270,435 to Sodaro discloses a rearward-deployed mechanical broadhead in which the blades are spring loaded toward the deployed configuration. The blades are retained for flight by a retaining ring that is dislodged during impact to allow the blades to move to their deployed configuration. U.S. Pat. No. 7,717,814 to Sanford discloses a rearward-deployed mechanical broadhead in which the blades are spring loaded toward the deployed configuration. The blades are held in the retracted configuration for flight by means of a catch that is released when a plunger element strikes the target. As can be determined from the foregoing, although rearward-deployed mechanical broadheads have the advantage of using less impact energy for deployment, they suffer from a high degree of mechanical complexity and cost. Prior art rearward-deployed broadheads also suffer from the fact that the blades in the deployed configuration are effectively locked to the ferrule by the deployment springs, and therefore, if a blade strikes an obstruction, the arrow is likely to be deflected, penetration significantly reduced, and/or the blade damaged.

U.S. Pat. No. 6,910,979 to Barrie et al. discloses a rearward-deployed mechanical broadhead in which the blades translate rearward by the interaction with the target. As the blades translate rearward, they are cammed outward along a track that causes the blades to extend outward to a locked, deployed configuration. The mechanical broadhead of Barrie et al. is considerably less complex then the spring-loaded rearward-deployed mechanical broadheads of Sodaro and Sanford, however, because the blades of Barrie et al. in the deployed configuration are still locked to the ferrule, the Barrie broadhead suffers from the same vulnerability if a blade strikes an obstruction.

SUMMARY OF THE INVENTION

The present invention comprises a mechanical broadhead in which the blades are held in a retracted configuration for flight and, upon impact with the target, move to a deployed configuration. According to an illustrative embodiment, the blades are substantially L-shaped and are pivoted about a common axis located near the bend in the L. During flight, the short leg of the L is exposed, while the long leg of the L is retracted within the body of the ferrule. Upon impact with the target, resistance from the target presses the exposed, short leg of the L backwards. This causes the short leg to lever the longer blade portion outward. As the blade portions move outward, locking tabs formed on each of the blades ride over each other then act as stops to prevent the blades from moving back into the retracted position. This effectively locks the blades in the deployed configuration relative to each other, but the blades remain freely pivotable about the ferrule. Thus, if one blade strikes an obstruction such as a solid bone, the blade assembly simply pivots out of the way without damaging the blade, deflecting the trajectory of the arrow, or halting its penetration.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
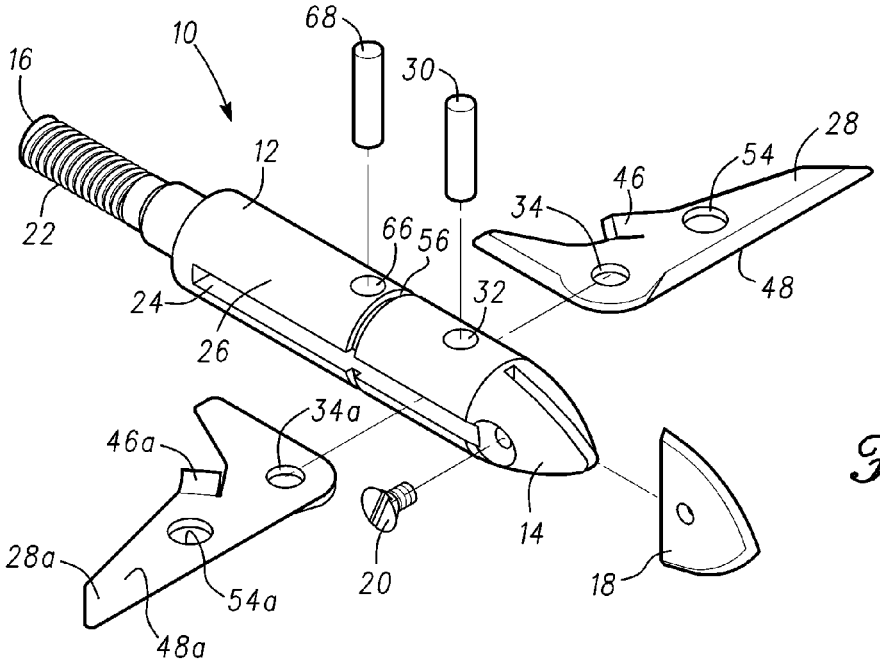
FIG. 1 is an exploded, perspective view of a mechanical broadhead incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and detailed description are not intended to limit the invention to the particular form disclosed, but are merely illustrative and intended to teach one of ordinary skill how to make and/or use the invention claimed herein and for setting forth the best mode for carrying out the invention.

With reference to FIGS. 1-6 and in particular, FIG. 1, a mechanical broadhead 10 incorporating features of the present invention comprises a ferrule 12 having a front end 14 and a rear end 16. Front end 14 may be of any conventional shape such as conical, faceted, or ogival etc. with, or without a fixed blade, however, in the illustrative embodiment of FIG. 1, front end 14 has an ogival contour and includes a fixed blade 18 which is secured to ferrule 12 by means of threaded fastener 20. Rear end 16 of ferrule 12 is adapted to be attached to an arrow shaft for example by means of threads 22 formed in rear end 16 of ferrule 12. Ferrule 12 may be formed of any suitable material such as steel, titanium, composite or plastic, but in the illustrative embodiment is formed of a lightweight aluminum alloy.

Ferrule 12 includes a slot 24 that extends diametrically through ferrule 12 for a majority of the length of the cylindrical portion 26 of ferrule 12. Pivoting blades 28, 28*a* are pivotably secured within slot 24 by means of shaft 30 which is threaded or pressed into aperture 32 formed in ferrule 12 and which registers in journals 34, 34*a* formed in pivoting blades 28, 28*a*.

Figure 2:
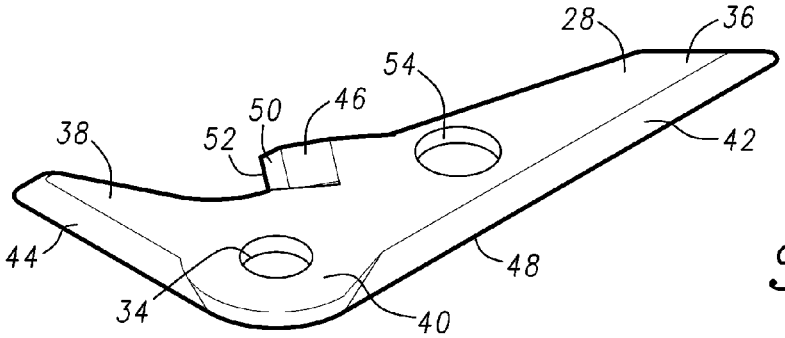
FIG. 2 is a perspective view of a moveable blade incorporating features of the present invention.
Figure 4:
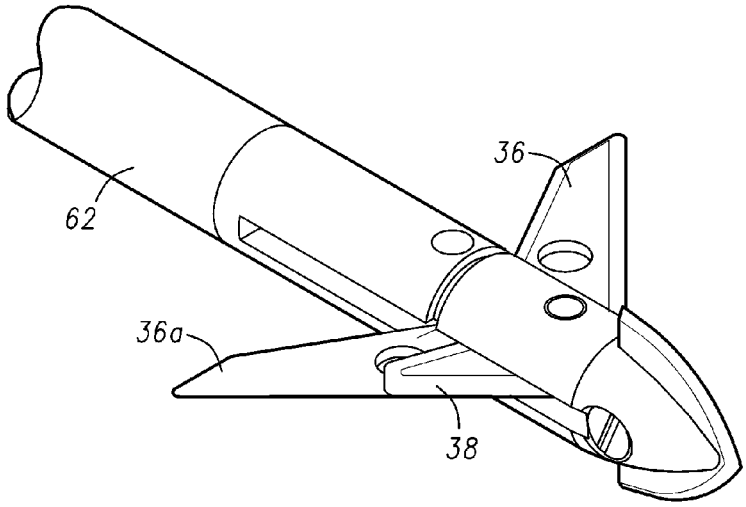
FIG. 4 is a perspective view of the mechanical broadhead of FIG. 1 with the blades in the deployed configuration.

With particular reference to FIG. 2, pivoting blade 28 comprises a substantially L-shaped blade formed of steel or other suitable material comprising a longer blade portion 36 and a shorter lever portion 38 extending away from the hub portion 40 containing journal 34. The forward edge 42 of blade portion 36 is beveled preferably to a razor sharp edge to facilitate penetration into the target. Similarly, as shown in FIG. 4, the trailing edge of blade portion 36 is also beveled to a sharp edge. The leading edge 44 of lever portion 38 is beveled to reduce wind resistance but preferably is left somewhat dull. Leading edge 44 is preferably left dull so that it does not penetrate the target by itself, but instead the target resistance against leading edge 44 causes lever portion 38 to lever blade portion 36 outward as mechanical broadhead 10 impacts the target. Pivoting blade 28 further includes a locking tab 46 which extends below lower surface 48 of the remainder of pivoting blade 28 a sufficient amount to lock the pivoting blades together as described more fully hereinafter, but preferably about 0.005 to 0.025 inch and most preferably about 0.015 inch. Locking tab 46 includes a beveled region 50 that terminates in an edge 52 which lies substantially along a radial line extending from the center of journal 34. Pivoting blade 28 further includes a locking aperture 54 the function of which will be explained more fully hereinafter.

Figure 3:
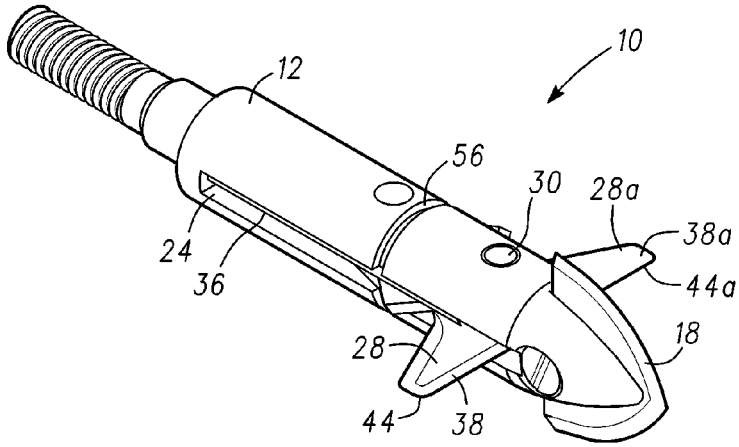
FIG. 3 is a perspective view of the mechanical broadhead of FIG. 1 with the blades in the retracted configuration.

FIG. 3 shows mechanical broadhead 10 in the flight configuration with pivoting blades 28, 28*a* in their retracted, in-flight configuration with the blade portions 36 substantially concealed within slot 24 formed in ferrule 12. A frangible retainer such as a rubber band, piece of thread, etc. may optionally be placed in groove 56 to retain pivoting blades 28, 28*a* in the retracted configuration during flight. Alternatively, ferrule 12, pivoting blades 28, 28*a* and/or shaft 30 may be configured to provide sufficient friction to retain pivoting blades 28, 28*a* in the retracted configuration thus obviating the need for a separate retainer.

Figure 5:
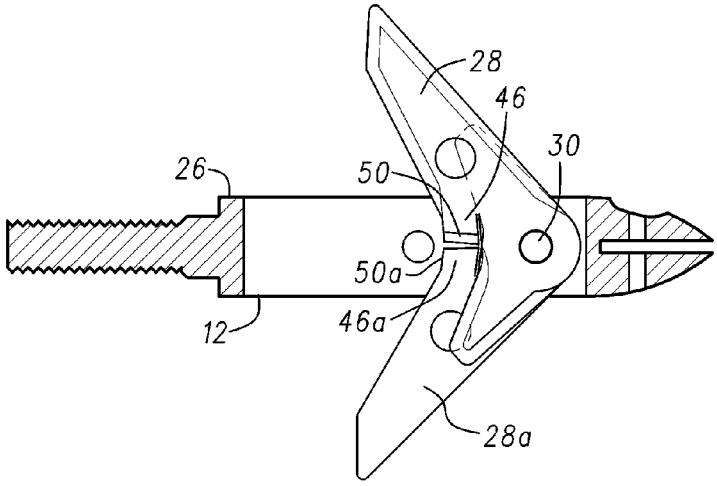
FIG. 5 is a partial cross-sectional view of the mechanical broadhead of FIG. 1 with the blades in the deployed configuration.

With additional reference to FIGS. 4 and 5, as mechanical broadhead 10 impacts a target, leading edges 44, 44*a* of lever portions 38, 38*a* encounter resistance from the target. This creates a torque couple around shaft 30 which causes blade portions 36, 36*a* to be rotated outward from the retracted configuration to the deployed configuration as shown in FIGS. 4 and 5. With particular reference to FIG. 5, as pivoting blades 28, 28*a* move to the fully deployed configuration, locking tabs 46, 46*a* pass over each other and, because the locking tabs 46, 46*a* extend below the lower surface of pivoting blades 28, 28*a*, locking tabs 46, 46*a* ride over each other then snap into position where the beveled regions 50, 50*a* can not pass over each other in the opposite direction. Locking tabs 46, 46*a* act as stops that effectively lock the blades into the deployed configuration against the resistance of the target, but because the blades are locked to each other rather than to the ferrule, the blades in the deployed configuration are still free to rotate together about shaft 30 and ferrule 12.

Figure 6:
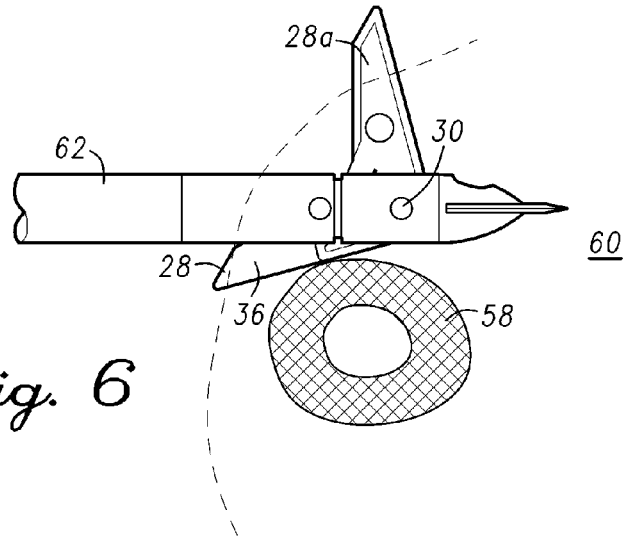
FIG. 6 is a plan view of the mechanical broadhead of claim 1 striking an obstruction within the target.
Figure 7:
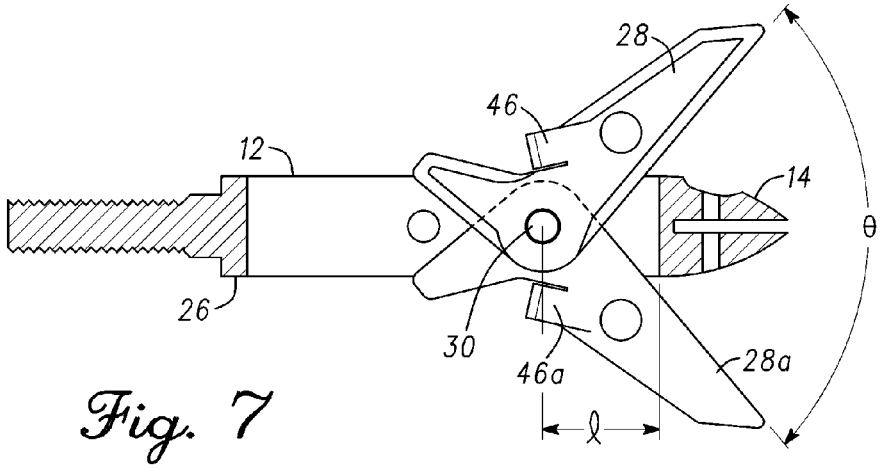
FIG. 7 is a cross sectional view of the mechanical broadhead of claim 1 being withdrawn from a target.

The present invention has a significant advantage over prior art mechanical broadheads in that with the blades 28 and 28*a* locked together in the deployed configuration, if the blade portion of one of the blades impacts an obstruction (for example if blade portion 36 of blade 28 strikes a bone 58 within target 60 as shown in FIG. 6), the pivoting blades 28 and 28*a* will simply rotate in unison about shaft 30 without deflecting the trajectory of arrow 62 or worse damaging a blade or stopping the penetration of arrow 62 altogether. Finally, because locking tabs 46, 46*a* are in reality merely stops that prevent pivoting blades 28, 28*a* from rotating inward/rearward toward the retracted configuration relative to each other, and because slot 24 extends a sufficient distance "l" forward of shaft 30, pivoting blades 28, 28*a* are free to rotate independently forward, for example to an included angle θ as the arrow is withdrawn from the target as shown in FIG. 7. This prevents pivoting blades 28, 28*a* from "barbing" which is illegal in many states.

It is also well recognized in the art that the flight characteristics of broadheads and practice tips are usually different. It is desirable to practice with arrows having identical flight characteristics as the hunting broadhead, however, using a broadhead on a target is unduly destructive to both the target and the broadhead unless the blade deployment mechanism can be disabled. For this reason, mechanical broadhead 10 includes an aperture 66 that registers with the locking apertures 54, 54*a* formed in pivoting blades 28, 28*a* when pivoting blades 28, 28*a* are in the retracted configuration. A locking pin 68 is inserted through aperture 66 and locking apertures 54, 54*a*. Locking pin 68 is sufficiently robust to prevent rotating blades 28, 28*a* from deploying upon impact with the target. This enables mechanical broadhead 10 to be used as a practice tip without undue destruction of the practice target or dulling of the forward edges 42 of the blade.

Figure 8:
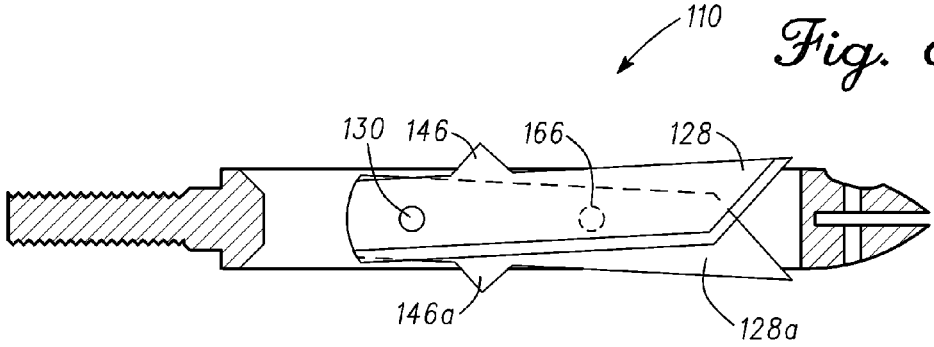
FIG. 8 is a cross-sectional view of an alternative forward-deployed mechanical broadhead incorporating features of the present invention with the blades in the retracted configuration.
Figure 9:
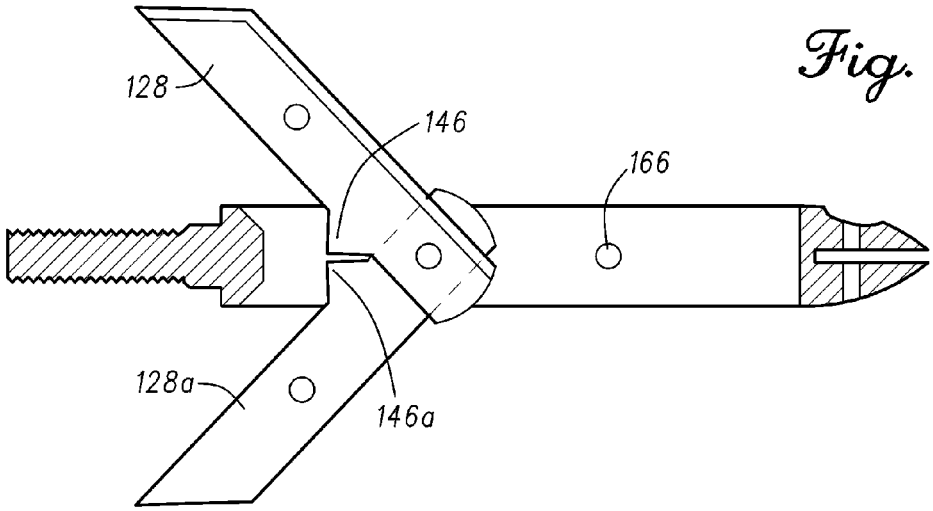
FIG. 9 is a cross-sectional view of an alternative forward-deployed mechanical broadhead incorporating features of the present invention with the blades in the deployed configuration.

With reference to FIGS. 8 and 9, in an alternative embodiment of a mechanical broadhead 110, pivoting blades 128, 128*a* are mounted about a common shaft 130. Pivoting blades 128, 128*a* each include a locking tab 146, 146*a*. As mechanical broadhead 110 impacts the target, the impact forces cause pivoting blades 128, 128*a* to rotate outwards until locking tabs 146, 146*a* engage corresponding surfaces on blades 128*a* and 128 respectively. As with the embodiment of FIGS. 1-6, although blades 128 and 128*a* are locked together they remain free to rotate about shaft 130. As with the embodiment of FIGS. 1-7, the embodiment of FIGS. 8 and 9 can be locked into the retracted position for practice by inserting a locking pin into locking aperture 166.

Although certain illustrative embodiments and methods have been disclosed herein, it will be apparent from the foregoing disclosure to those skilled in the art that variations and modifications of such embodiments and methods may be made without departing from the invention. For example, although in the illustrative embodiments the blades are deployed by direct interaction with the target, spring-loaded and/or plunger-deployed blades are considered within the scope of the present invention, as well as any mechanical broadhead in which the blades are locked together rather than being locked to the ferrule. Additionally, although the blades in the illustrative embodiment are symmetrical, asymmetrical blades including asymmetrical blades in which the stop member is formed on only one of the blades are considered within the scope of the present invention. Accordingly, it is intended that the invention should be limited only to the extent required by the appended claims and the rules and principles of applicable law. Additionally, as used herein, unless otherwise specifically defined, the terms "substantially" or "generally" when used with mathematical concepts or measurements mean within ±10 degrees of angle or within 10 percent of the measurement, whichever is greater.

What is claimed is:

1. An arrow head comprising:

an elongate body portion adapted to be mounted to an arrow, said elongate body portion including a slot extending longitudinally through the elongate body portion; and first and second blades disposed within the slot and mounted to pivot about a pivot axis; the first and second blades being rotatable outward about the pivot axis from a retracted, in flight configuration to a deployed, penetrating configuration, the first of the plurality of blades having a stop member that engages a corresponding surface of the second blade to prevent the first and second blades from retracting from the deployed, penetrating configuration relative to each other while the deployed, penetrating configuration remains freely pivotable about the body portion;

the slot extending a sufficient distance forward of the pivot axis to enable the first and second blades to pivot forward independently to prevent barbing upon removal of the arrow head from a target.

2. The arrow head of claim 1, wherein:

the first and second blades each has a leading edge and a trailing edge; and the stop member comprises a tab formed on the trailing edge of the first blade.

3. The arrow head of claim 2, further comprising:

a stop member comprising a tab formed on the trailing edge of the second blade.

4. The arrow head of claim 1, wherein:

the first and second blades are substantially L-shaped in plan view with a relatively shorter actuator portion and a relatively longer blade portion.

5. The arrow head of claim 1, wherein:

the first and second blades are forward deploying.

6. The arrow head of claim 1, wherein:

the first and second blades are rearward deploying.

7. A method of deploying blades from an arrow head upon impact with a target comprising:

disposing each of a plurality of blades in a retracted, in flight position, at least partially within a recess formed in an elongate body portion;

during impact with the target, pivoting each of the plurality of blades outward from the retracted configuration to a predetermined deployed configuration;

causing a stop member formed on a first one of the plurality of blades to engage a surface of a second one of the plurality of blades to prevent the plurality of blades from retracting from the deployed configuration relative to each other, while allowing the blades in the deployed configuration to freely rotate about the body portion during impact; and after impact, pivoting the blades forward independently, thereby causing the stop member formed on the first blade to disengage the surface of the second blade as the arrow head is withdrawn from the target and further pivoting the plurality of blades forward to prevent barbing.

8. The method of claim 7 wherein:

the stop member comprises a tab formed on a trailing surface of the first one of the plurality of blades.

9. An arrow head comprising:

an elongate body portion adapted to be mounted to an arrow;

a plurality of blades mounted to the body portion; the plurality of blades being moveable outward from a retracted, in flight configuration to a deployed, penetrating configuration; and means for holding the plurality of blades fixed in the deployed configuration relative to each other while allowing the blades in the fixed, deployed configuration to move relative to the body portion, and means for retaining the blades in a retracted, in flight configuration during impact, said means for retaining the blades in a retracted, in flight configuration during impact comprising a shear pin inserted through the body and the plurality of blades at a location offset from the pivot axis.

10. The arrow head of claim 9, wherein:

the plurality of blades pivot about a common pivot axis.

11. The arrow head of claim 9, wherein:

the means for holding the plurality of blades fixed in the deployed configuration comprises a stop member formed on a first one of the plurality of blades that engages a surface of a second one of the plurality of blades.

12. An arrow head comprising:

an elongate body portion adapted to be mounted to an arrow, said elongate body portion comprising a slot extending longitudinally through the elongate body portion; and first and second blades disposed within the slot and mounted to pivot about a pivot axis; the first and second blades being rotatable outward about the pivot axis from a retracted, in flight configuration to a deployed, penetrating configuration, the first of the plurality of blades having a stop member that engages a corresponding surface of the second blade to prevent the first and second blades from retracting from the deployed, penetrating configuration relative to each other while the deployed, penetrating configuration remains freely pivotable about the body portion, wherein the first and second blade portions each comprise a sharpened leading edge and a sharpened trailing edge.

13. An arrow head comprising:

an elongate body portion adapted to be mounted to an arrow, said elongate body portion including a slot extending longitudinally through the elongate body portion; and first and second blades each having first and second blade portions, said first and second blades being disposed within the slot such that the first and second blade portions are substantially concealed within the slot, said first and second blades being mounted to pivot about a pivot axis; the first and second blades being rotatable outward about the pivot axis from a retracted, in flight configuration to a deployed, penetrating configuration, the first of the plurality of blades having a stop member that engages a corresponding surface of the second blade to prevent the first and second blades from retracting from the deployed, penetrating configuration relative to each other while the deployed, penetrating configuration remains freely pivotable about the body portion.

* * * * *